US012351969B2

(12) United States Patent
Yuen

(10) Patent No.: US 12,351,969 B2
(45) Date of Patent: Jul. 8, 2025

(54) WASHING MACHINE WITHOUT AN EXTERNAL DRUM

(71) Applicant: Long Wang Yuen, Hong Kong (HK)

(72) Inventor: Long Wang Yuen, Hong Kong (HK)

( * ) Notice: Subject to any disclaimer, the term of this patent is extended or adjusted under 35 U.S.C. 154(b) by 268 days.

(21) Appl. No.: 18/074,803

(22) Filed: Dec. 5, 2022

(65) Prior Publication Data

US 2024/0117555 A1 Apr. 11, 2024

(30) Foreign Application Priority Data

Oct. 11, 2022 (HK) ..... 32022061927.6

(51) Int. Cl.

| | |
|---|---|
| ***D06F 37/04*** | (2006.01) |
| ***D06F 39/02*** | (2006.01) |
| ***D06F 39/04*** | (2006.01) |
| ***D06F 39/08*** | (2006.01) |

(52) U.S. Cl.

CPC ..... *D06F 37/04* (2013.01); *D06F 39/02* (2013.01); *D06F 39/04* (2013.01); *D06F 39/088* (2013.01)

(58) Field of Classification Search

CPC ..... D06F 23/025; D06F 23/065; D06F 21/02; D06F 37/04

See application file for complete search history.

(56) References Cited

U.S. PATENT DOCUMENTS

| | | | | | |
|---|---|---|---|---|---|
| 2,292,787 | A * | 8/1942 | Johnson | D06F 21/02 | 68/144 |
| 3,919,865 | A * | 11/1975 | Glandfield | C14C 15/00 | 451/328 |
| 4,941,333 | A * | 7/1990 | Blessing | D06F 23/025 | 68/19.2 |
| 2015/0135779 | A1* | 5/2015 | Kim | D06F 23/025 | 68/140 |
| 2015/0176173 | A1* | 6/2015 | Kim | D06F 39/088 | 68/140 |

(Continued)

FOREIGN PATENT DOCUMENTS

| | | | | |
|---|---|---|---|---|
| DE | 3935382 A1 * | 5/1990 | | |
| EP | 3988706 A1 * | 4/2022 | ..... | D06F 23/025 |

(Continued)

*Primary Examiner* — Spencer E. Bell
(74) *Attorney, Agent, or Firm* — WPAT, PC

(57) ABSTRACT

A washing machine without an external drum, comprising a single washing drum, and the functions of ordinary washing machines such as water injection, washing, drain, and dehydration are completed in the washing drum. Firstly, it simples the problem of the existing double drum washing machine to keep clean of the outer drum. Users can easily place and take out clothes by the opening of the washing drum, and clean the inner wall of the washing drum. So that the clothes will not contact with the other parts other than the inner wall of the washing drum, which prevents the clothes from being contaminated during the washing process. Secondly, the manufacturing cost of the washing machine can be saved to reduce the design of the outer drum. And since the water is only injected into a single washing drum during cleaning, it can save a lot of water compared with the existing double drum washing machine, and reduce laundry detergent, etc., so it is more environmentally friendly.

13 Claims, 9 Drawing Sheets

(56) References Cited

U.S. PATENT DOCUMENTS

| | | | | |
|---|---|---|---|---|
| 2015/0176175 | A1* | 6/2015 | Kim | D06F 37/10 68/139 |
| 2020/0149208 | A1* | 5/2020 | Li | D06F 37/267 |
| 2021/0156069 | A1* | 5/2021 | Lv | D06F 39/083 |

FOREIGN PATENT DOCUMENTS

| | | | | |
|---|---|---|---|---|
| FR | 2625517 | A1 * | 7/1989 | |
| WO | WO-2020233449 | A1 * | 11/2020 | D06F 23/02 |
| WO | WO-2020256658 | A1 * | 12/2020 | |

* cited by examiner

WASHING MACHINE WITHOUT AN EXTERNAL DRUM

FIELD OF THE INVENTION

The invention involves a washing machine, in particular a washing machine with a single washing drum.

BACKGROUND OF THE INVENTION

At present, the washing machines on the market, including the top load and front load washing machines, adopt a double drums design, that is an inner drum and an outer drum. The inner drum is driven by a motor to complete operations such as washing, draining, and drying, while the outer drum is fixed and used to set the water inlet and drain to cooperate with the inner drum for completing all the laundry procedures. The double drums design can simplify the water inlet and drain of the washing machine, but it causes hygienic problems. Since the inner drum and outer drum of the washing machine cannot be easily disassembled for the user. After long-term use, the outer wall of the inner drum, the inner wall and where between, will hold a lot of dirt and may generate bacteria, etc. It cannot be cleaned. Then during the subsequent laundry process, the dirt and bacteria can contaminate the clothes in the inner drum. Although there are some detergents for cleaning washing machine drums on the market for washing the machine drums, which are designed to remove dirt and bacteria by soaking and washing, the effectiveness of these detergents is doubted as the outer walls of the inner drum and the inner walls of the outer drum are not reachable by hand or other equipment, and even not observable.

SUMMARY OF THE INVENTION

In view of the aforesaid drawbacks of the prior art, the present invention provides the washing machine without an external drum, combining the inner drum of the existing washing machine to form a single drum design, so that to improve the washing machine for completing the washing function without any further cleaning procedure of the drum, but ensuring hygiene, saving detergents and water, etc.

The invention provides the following solutions:

A washing machine without an external drum, comprises a washing drum which is provided inside the washing machine, the washing drum is provided with an opening for placing and removing laundry;

drain holes are provided on the washing drum;

a valve for opening or closing all drain holes is provided on the washing drum and located at a corresponding position of the drain hole.

Further, the front end of the washing drum is smaller in diameter than the rear end, and the washing drum is in the shape of a truncated cone.

Further, a bevel is provided between the rear end and the side wall of the washing drum, and the drain holes are distributed on the bevel; the valve is at least one set of a sealing ring which is connected with a locking device for opening or closing the drain holes.

Further, a water inlet mechanism is provided; the water inlet mechanism comprises a water valve provided on the washing drum; a water channel is provided in the water valve and moves in the radial direction to connect the inner wall of the washing drum and the water pipe; during filling water, the water pipe pushes the water valve to move toward the inner wall of the washing drum and connects the water pipe to the inner wall by the water channel; after filing, the water valve moves outwards to close the water channel.

Further, the locking device is mounted on the spindle of the washing drum by a bearing and can be moved in the axial direction along the spindle; the locking device is also provided with a shaft, which is set in a tilted track; the track is connected to a movement driver.

Further, the sealing ring is pivotally installed on the rear end of the washing drum and is connected to a reset spring; the locking device comprises at least a clasp, which is movably mounted on the rear end of the washing drum; when locked, the clasp locks the sealing ring in position to close the drain holes.

Further, the drain holes are divided into several groups and set along the bevel, each group of drain holes is provided with a set of sealing ring, a reset spring and a locking device.

Further, the locking device provides a slide-to-close device for pushing the sealing ring to the position of closing the drain holes; the slide-to-close device moves along the axial direction which is parallel to the shaft of the washing drum; a plate is provided for pushing the sealing ring to the drain holes.

Further, an unlocking device is provided, and it is a collision block which is contacted with the clasp to unlock the sealing ring from the clasp; the collision block is L-shaped, one end is pivotally installed to the unlocking device and the other end is connected to the unlocking device by a compressed spring.

Further, a water inlet mechanism is provided; and it comprises a positioning device for aligning the washing drum with the water inlet mechanism and a filling control device; during water filling, the positioning device aligns the outlet of the filling control device with the drain holes of the washing drum.

Further, the positioning device can move parallel along the axial direction of the shaft of the washing drum, which comprises a block; when locking the washing drum, the block contact with one of the washing drum, the sealing ring or the clasp to stop the rotation of the washing drum.

Further, the filling control device comprises a water tank which can move parallel along the axial direction of the washing drum, and the water tank connects to a water supply by a water pipe.

Further, the filling control device comprises a water tank which can move parallel along the axial direction of the washing drum, and the water tank connects to a water supply by a water pipe.

Further, the water supply comprises a detergent dispenser, an inlet of the detergent dispenser connects to the water pipe, and an outlet of the detergent dispenser connects to the water tank.

Further, the water pipe of the water supply connects to a heater, and the outlet of the heater connects to the water tank.

Further, a water basin is provided under the washing drum for receiving the water discharged from the drain holes, the water level in the water basin is lower than the lowest position of the washing drum.

The benefits of the present invention are: using a single washing drum to complete the functions of the ordinary washing machine such as water filling, washing, draining and de-watering in the drum, is more simple in structure. During water filling, the water inlet or the drain holes can be opened to let the water pipe fill the drum; during washing, the drain holes are closed to keep the washing drum sealed to roll the drum and finish the whole process of the laundry; during drainage, the drain holes are opened to drain the washing drum; during dehydration, the drain holes keep opening and the washing drum rolls in high speed, and due to the truncated cone design of the drum, water flows along the inner wall to the drain holes and is discharged. The above design can simplify the problem of how to clean up the double drums washing machine. The user can easily clean the inner wall of the washing drum while placing or taking the clothes. Also, water and clothes will not contact with other places than the inner wall of the washing drum to prevent the clothes from being contaminated during the washing process. Further, the manufacturing cost of the washing machine can be saved by reducing the design of the outer drum. And, as water is only injected into a single drum during washing, it is possible to save a lot of water and reduce the amount of detergent, etc., compared to the existing double drums washing machine, which is more environmentally friendly.

BRIEF DESCRIPTION OF THE DRAWINGS

The invention is further illustrated in the accompanying drawings as follows.

DESCRIPTION OF THE EMBODIMENTS

Figure 1:
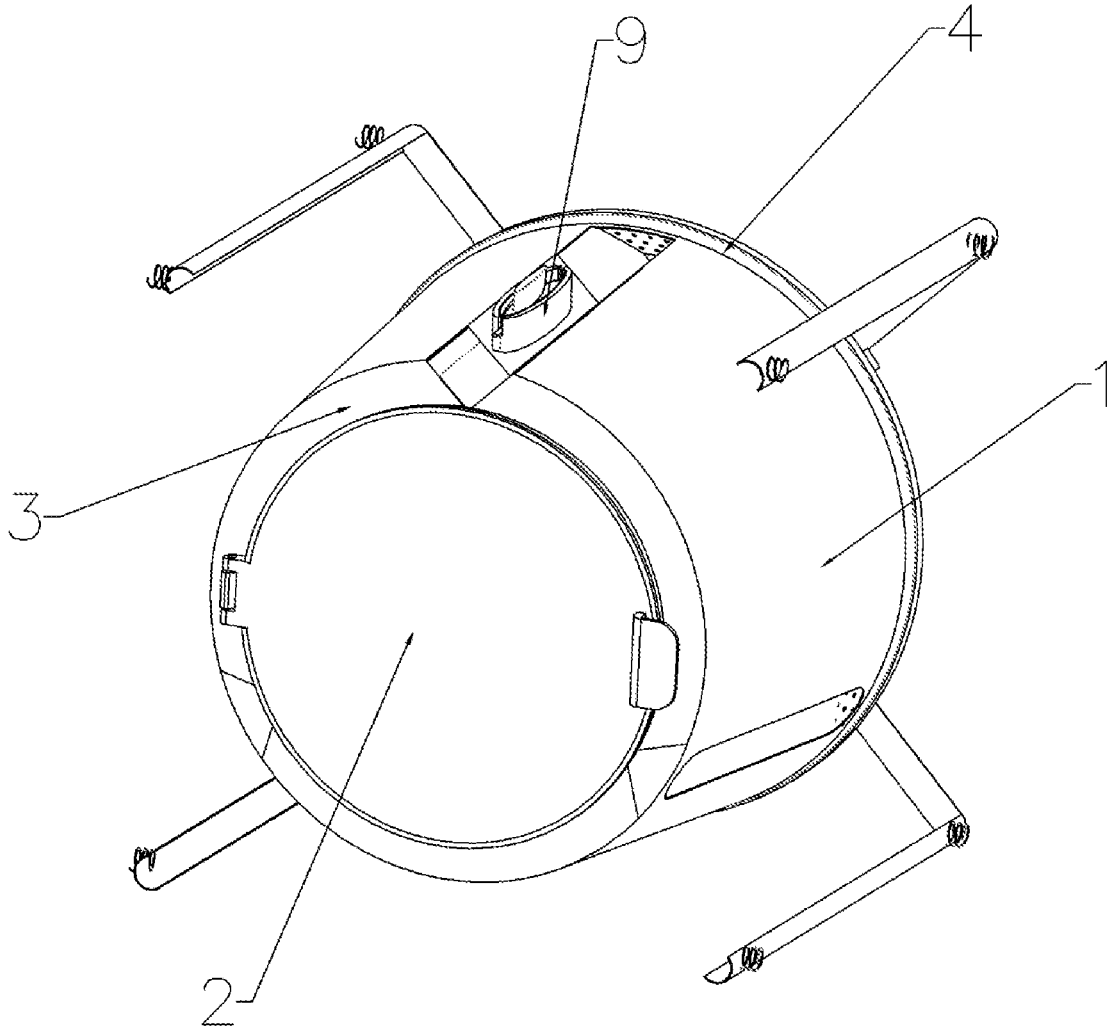
FIG. 1 is a perspective view of embodiment 1 of the present invention.

With reference to FIG. 1, the washing machine without an external drum 1 is provided with a single washing drum 1 in the washing machine. In the front end 3 of washing drum 1, an opening 2 is provided for putting and taking the laundry. According to the current design of washing machines, there are two kinds, the top load and front load washing machines, and the present invention can also be used for the above two kinds. For the top load one, the washing drum 1 is vertically set, and the opening 2 does not need a door to seal the washing machine drum, and for water filling, the water inlet is set at the opening 2 to refill the washing drum 1 with water as common top load washing machine do. For the front load one, the washing drum 1 should be horizontally set. The opening 2 can be set on the front end 3 or the side wall of the washing drum 1, and then a door is set and sealed the opening 2, and it rotates with the washing drum. So that the washing drum 1 is sealed during the washing process.

The drain holes 5 may be located on the side wall and/or the rear end 4 of the washing drum. However, considering that most of the control systems of the washing machine are installed on the rear end, referring to FIG. 2, especially for the drainage convenience of the top load type washing machine. Therefore, in the present invention, the drain holes 5 are preferably provided on the rear end 4 of the washing drum 1. These drainage holes 5 can be punched directly on the rear end 4. In order to drain faster and dehydrate. a large number of drain holes 5 need to be evenly arranged on the rear end 4. The rear end 4 of the washing drum 1 is provided with a valve for opening or closing all the drain holes 5. Different from the existing washing machine, the valve must be able to open and close all the drain holes 5, and the common drain valve of the existing washing machine cannot be achieved. The valve will be described in detail below. In addition, the drain holes 5 of the present invention must be sealed at a whole, so is different from the common drain holes 5 of the existing washing machine. If the drain holes 5 are set on the side wall as the existing washing machine does, the drain valve will be more complicated and cause leakage. Therefore, the present invention preferably provides the drain holes 5 on the rear end 4, but in order to improve the efficiency of drainage and dehydration, the diameter of the front end 3 of the washing drum 1 is smaller than the diameter of the rear end 4, and form a truncated cone shape. For a top load washing machine, the rear end 4, that is, the bottom surface of the washing drum 1, has a larger diameter, and more drainage holes 5 can be provided for drainage. At the same time, when dehydrating, the entire washing drum 1 fast rotates, although the side wall is not provided with drain holes 5, the water thrown out of the clothes will flow to the large diameter rear end 4 under the action of inertia and flow out through the drain holes 5, which can also achieve more efficient dehydration. For the front load washing machine, the rear end 4 is larger in diameter, and then the side wall forms an inclined surface from the front end 3 to the rear end 4, so that the water in the washing drum 1 can be fully drained along the inclined surface. During dehydration, water will also flow to the rear end 4 under the action of inertia to achieve drainage.

Similar to the drive mode of the conventional washing machine, the washing drum 1 is connected to the driving mechanism through the rotating shaft 6. The present invention also provides specific embodiments for reference. One end of the rotating shaft 6 of the washing drum 1 is connected to the motor of the washing machine, and the other end is provided with two or more sets of driving forks. The forks are matched with the groove of the washing drum 1 and embedded in the groove to fix.

Figure 2:
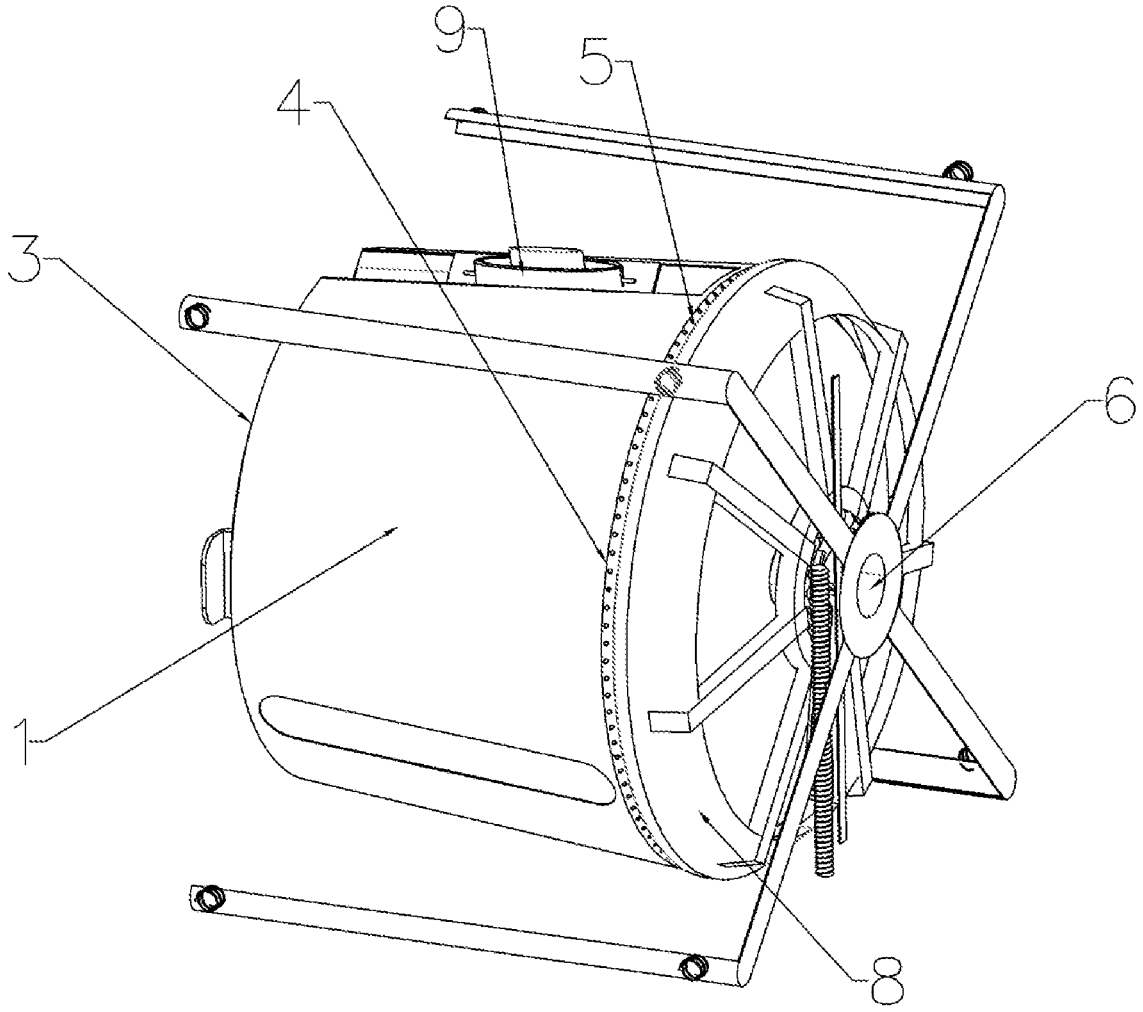
FIG. 2 is a perspective view of embodiment 1 from another angle of the present invention.
Figure 7:
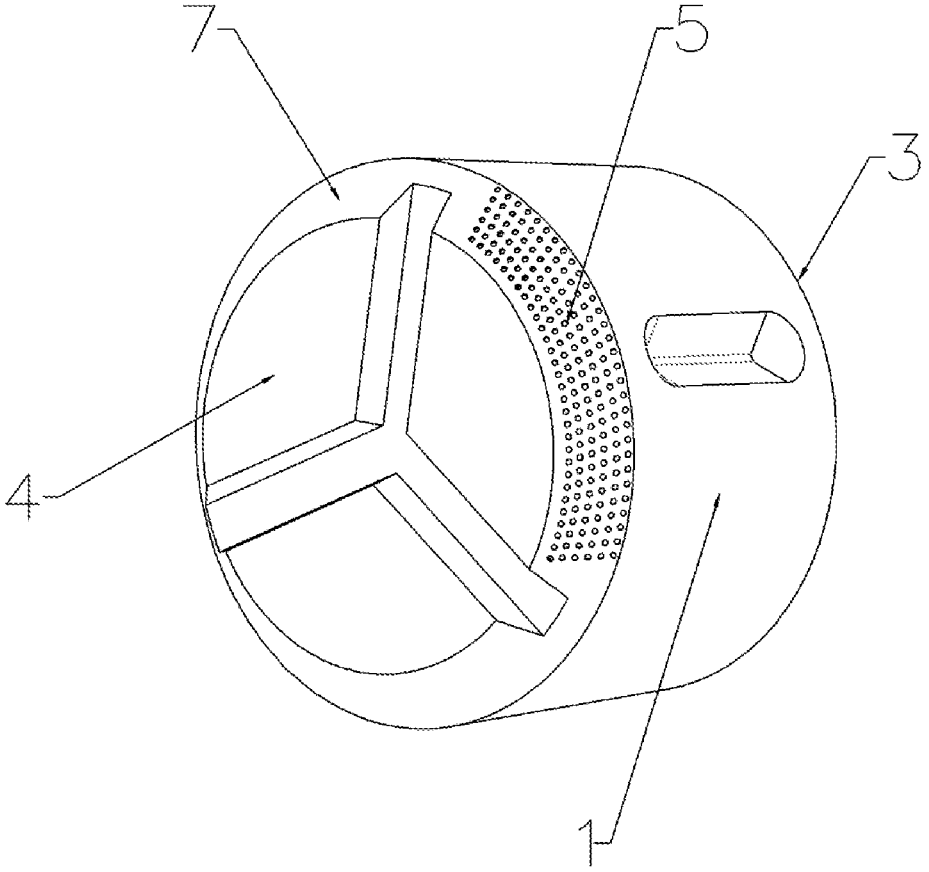
FIG. 7 is a perspective view of the washing drum in embodiment 2 from another angle of the present invention.

To further improve the drainage efficiency of the rear end 4, a bevel 7 is provided between the rear end 4 and the side wall of the washing drum 1, and the drain holes 5 are arranged on the bevel 7, referring to FIG. 2 and FIG. 7. The bevel 7 can provide larger drainage area, so that more drain holes 5 can be arranged to facilitate rapid drainage. Also, all the drain holes 5 must be closed after drainage, so the valve is at least one set of sealing ring 8 that fit with the surface of the bevel 7, and the sealing ring 8 can cover all the drain holes 5. The sealing ring 8 can open or close the drain hole 5 driven by the locking device.

Figure 3:
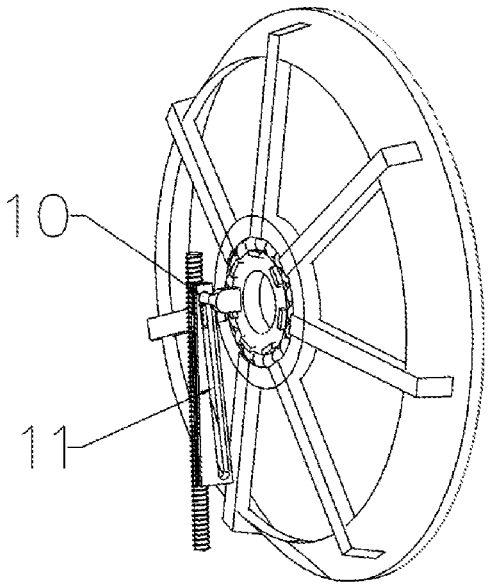
FIG. 3 is a perspective view of the locking device in embodiment 1 from another angle of the present invention.
Figure 4:
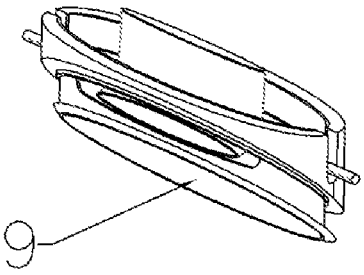
FIG. 4 is a perspective view of the water valve in embodiment 1 from another angle of the present invention.

The locking device can be implemented by using different structures according to different arrangements of the drain holes 5. One is that the locking device is sleeved on the spindle 6 of the washing drum 1 through a bearing. When the spindle 6 rotates, the locking device can move along the axial direction of the spindle 6. Specifically, the locking device is a claw plate, and the sealing ring 8 is fixed on the claw plate. The sealing ring 8 opens or closes the drain holes 5 through the forward and backward movement of the claw plate. For driving the claw plate, it is also provided with a shaft 10, and the shaft 10 is arranged in a tilted track 11, and then a movement driver drives the track 11 to move longitudinally. When the shaft 10 slides along the track 11, the claw plate is driven to move back and forth, referring to FIG. 3.

Figure 8:
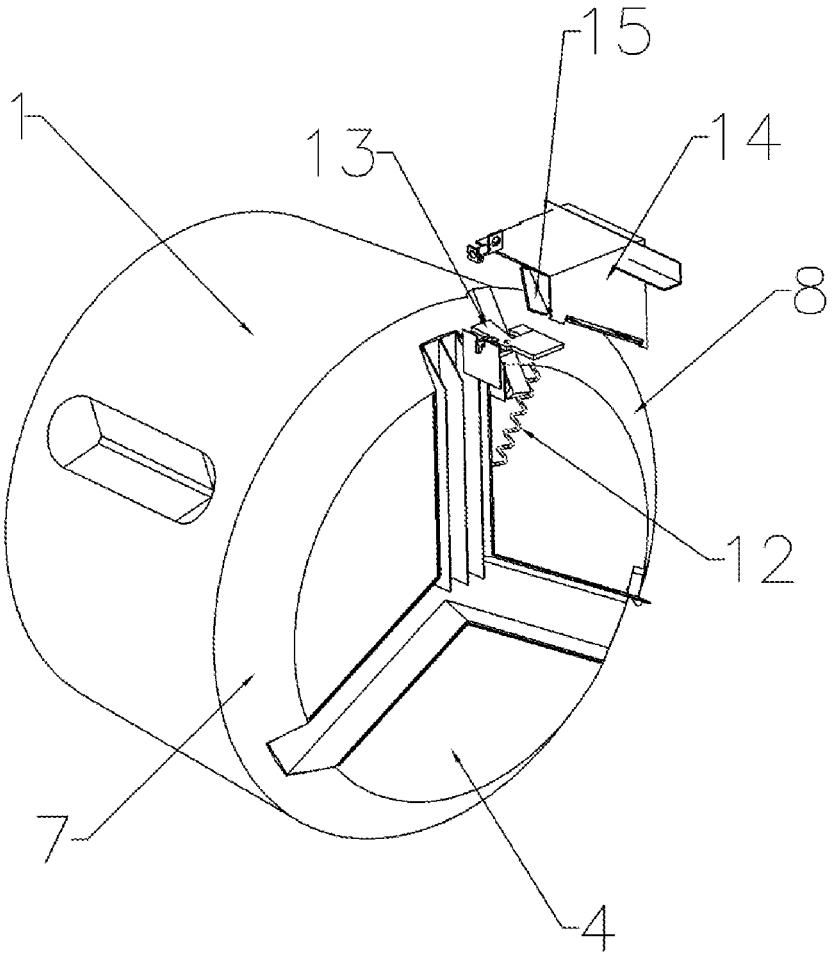
FIG. 8 is a perspective view of the locking device in embodiment 2 from another angle of the present invention.
Figure 9:
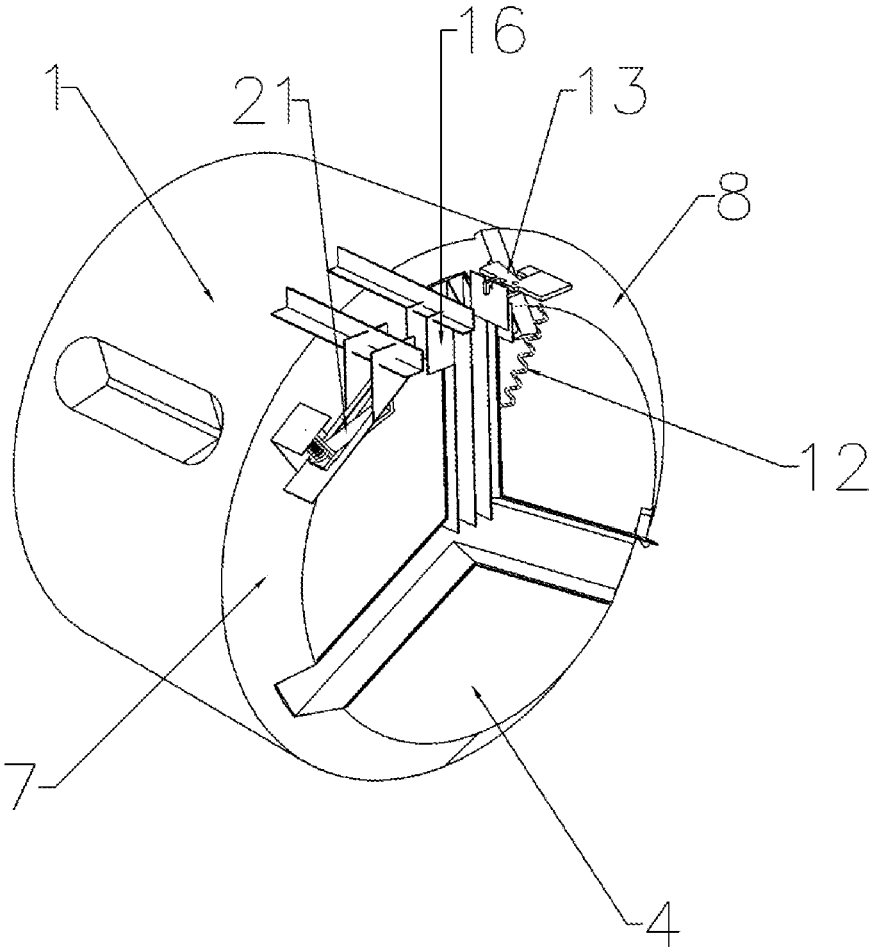
FIG. 9 is a perspective view of the positioning device in embodiment 2 from another angle of the present invention.

Another structure of the locking device is: the sealing ring 8 is rotatably mounted on the rear end 4 of the washing drum 1 and connected to the reset spring 12, and the reset spring 12 sets sealing ring 8 in an open state by default. The locking device at least includes a clasp 13, which is movably installed at the rear end of the washing drum 1, referring to FIG. 8. When locking, the clasp 13 moves to toward the sealing ring 8 and locks the sealing ring 8 to close the drain holes 5. When unlocking, just simply move the clasp 13 away, and the sealing ring 8 is opened under the action of the reset spring 12. Specifically, the clasp 13 is opened by the unlocking device, referring to FIG. 9. The unlocking device includes a collision block 21, which is L-shaped as a whole. One end of the collision block 21 is pivotally installed to the unlocking device, and the other end is connected to the unlocking device through a compressed spring. The unlocking device moves to the clasp 13, so that the clasp 13 is in contact with the collision block 21 and the clasp 13 is separated from the sealing ring, so the sealing ring 8 is opened under the action of the reset spring 12. When the washing drum 1 rotates, other parts of the washing drum 1 maybe collide with the collision block 21, the compressed spring then will be compressed, so that the collision block 21 will avoid stopping the washing drum 1 from rotating. To improve the drainage speed, the drain holes 5 can be divided into multiple groups along the bevel 7, and each group of drain holes 5 is respectively provided with a set of sealing ring 8, a reset springs 12 and a locking device. Because of the reset spring 12, the sealing ring 8 is set in an open state by default. In order to close the sealing ring 8, the locking device further includes a slide-to-close device 14 that pushes the sealing ring 8 to close the drain holes 5. The slide-to-close device 14 *c* moves along the axial direction which is parallel to the shaft of the washing drum 1, and is provided with a plate 15 for pushing the sealing ring 8 to close the drain holes 5. When the drain holes 5 need to be closed, the slide-to-close device 14 drives the plate 15 to move toward the washing drum 1 and pushes the clasp 13 overcoming the elastic force of the reset spring 12 to close the seal ring 8, and then the clasp 13 locks the seal ring 8.

For the top load washing machine, it is vertically placed and the opening 2 needs not to be sealed, so water can be directly filled through the opening 2. However, for front load washing machine, the opening 2 needs to be sealed after the clothes are put into the washing drum 1, so an additional water inlet mechanism must be provided, and the water inlet mechanism can be of various structures. One of the solutions is that the water inlet mechanism includes a water valve 9 arranged on the washing drum 1. The water valve 9 can move along the radial direction of the washing drum 1, and a water channel is provided in the water valve 9 to connect the inner wall of the washing drum 1 with the water pipe. When filling water, the washing drum 1 rotates to the position that let the water pipe align to the water valve 9, and is locked by the positioning device. The structure of the positioning device will be described in detail below. Then the water pipe pushes the water valve 9 moves toward the inner wall of the washing drum 1, so that the water channel connects the water pipe to the inner wall, and the valve of the water pipe is opened to fill water into the washing drum 1. After the water filling is completed, the water valve 9 moves outward to close the water channel to prevent water leakage. At the same time, the water pipe is also separated from the water valve 9 to avoid stopping the rotation of the washing drum 1.

Figure 10:
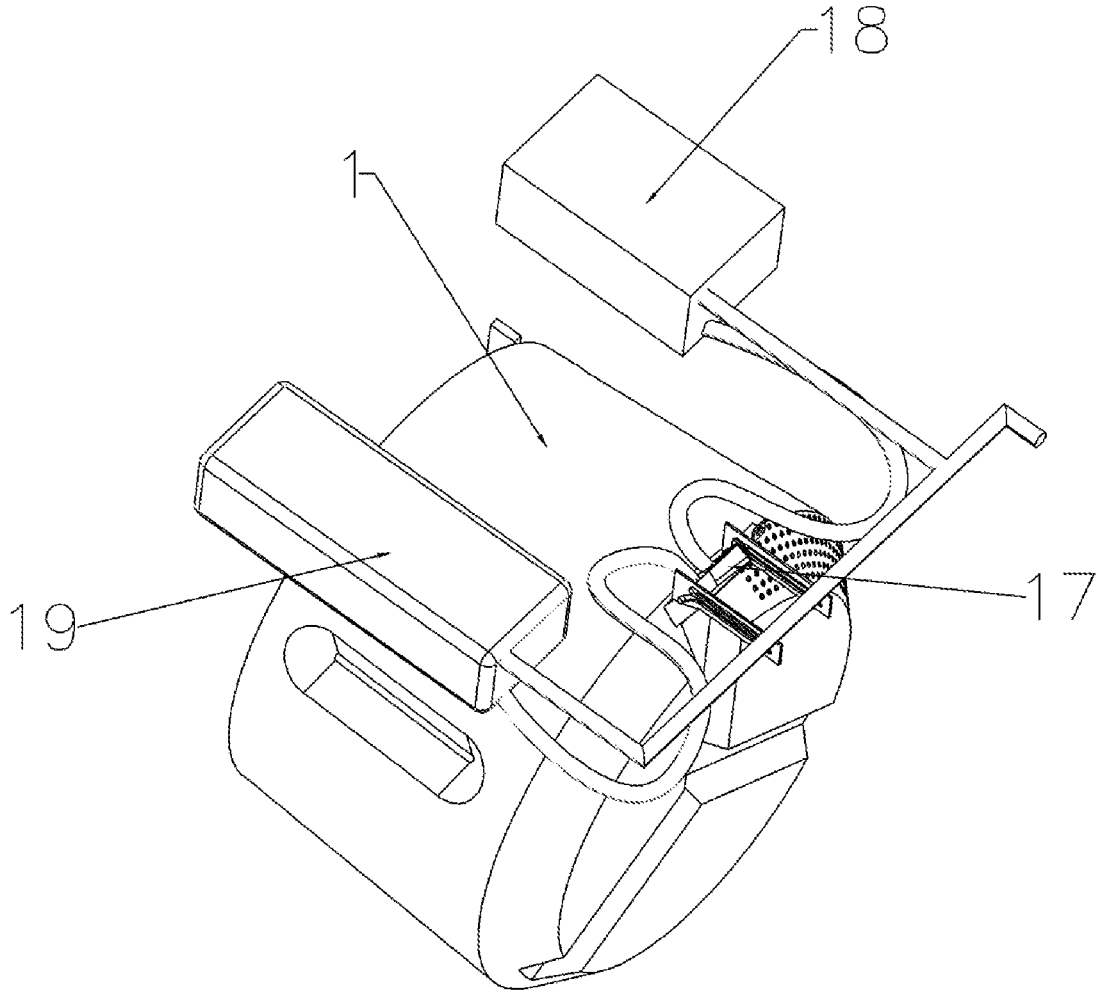
FIG. 10 is a perspective view of the water inlet mechanism in embodiment 2 from another angle of the present invention.

Another solution for the water inlet mechanism of the front load washing machine is to set the water inlet mechanism at the position of the drain holes 5 and directly fill water through the drain holes 5. In order to ensure the water inlet mechanism aligns with the drain holes 5 during water filling, the positioning device and a filling control device are provided for positioning the washing drum 1 and the water inlet mechanism, referring to FIG. 9. When filing water, the positioning device matches the drain holes 5 of the washing drum 1 with the water outlet of the filling control device. Specifically, the positioning device can be moved along an axial direction parallel to the rotation axis of the washing drum 1. It includes a block 16. When positioning the washing drum 1, the positioning device moves to the washing drum 1 to let the block 16 contact with the washing drum 1, the sealing ring 8 or the clasp 13 to prevent the washing drum 1 from rotating, so that the water outlet of the filling control device is aligned to the drain holes 5, and then open the sealing ring 8 to fill the washing drum 1 with water. Referring to FIG. 10, the filling control device includes a water tank 17 which moves axially parallel to the rotation axis of the washing drum 1. Since the drain holes 5 are arranged on the bevel 7, the water tank 17 must fit with the bevel 7 to prevent leakage, the water tank 17 is respectively set along two sets of slide rails, and at the end of one set of slide rails is provided with an inclined section. The water tanks 17 are respectively provided with rolling shafts corresponding to the two sets of slide rails. When the rolling shafts of the water tank 17 slide to the inclined section of the slide rails, the water tank 17 inclines to align the water outlet with the bevel 7.

The water tank 17 connects to the water supply through a water pipe, and the water supply includes a detergent dispenser 18, the inlet of which connects to the water pipe, and the outlet of which connects to the water tank 17 for providing room temperature water for washing. The water pipe also connects to the heater 19, and the outlet of the heater 19 connects to the water tank 17 for providing warm or hot water for washing.

Figure 5:
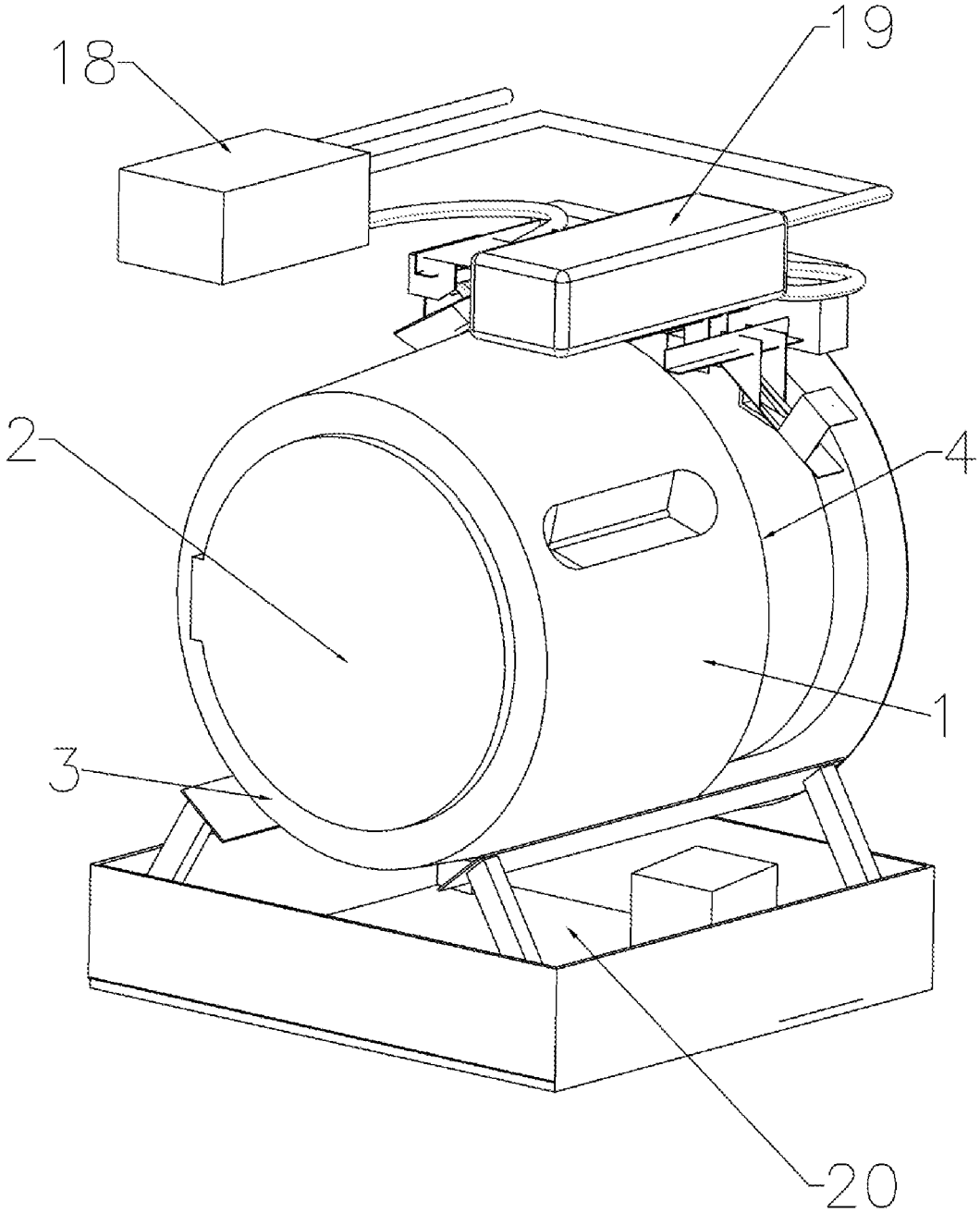
FIG. 5 is a perspective view of embodiment 2 from another angle of the present invention.
Figure 6:
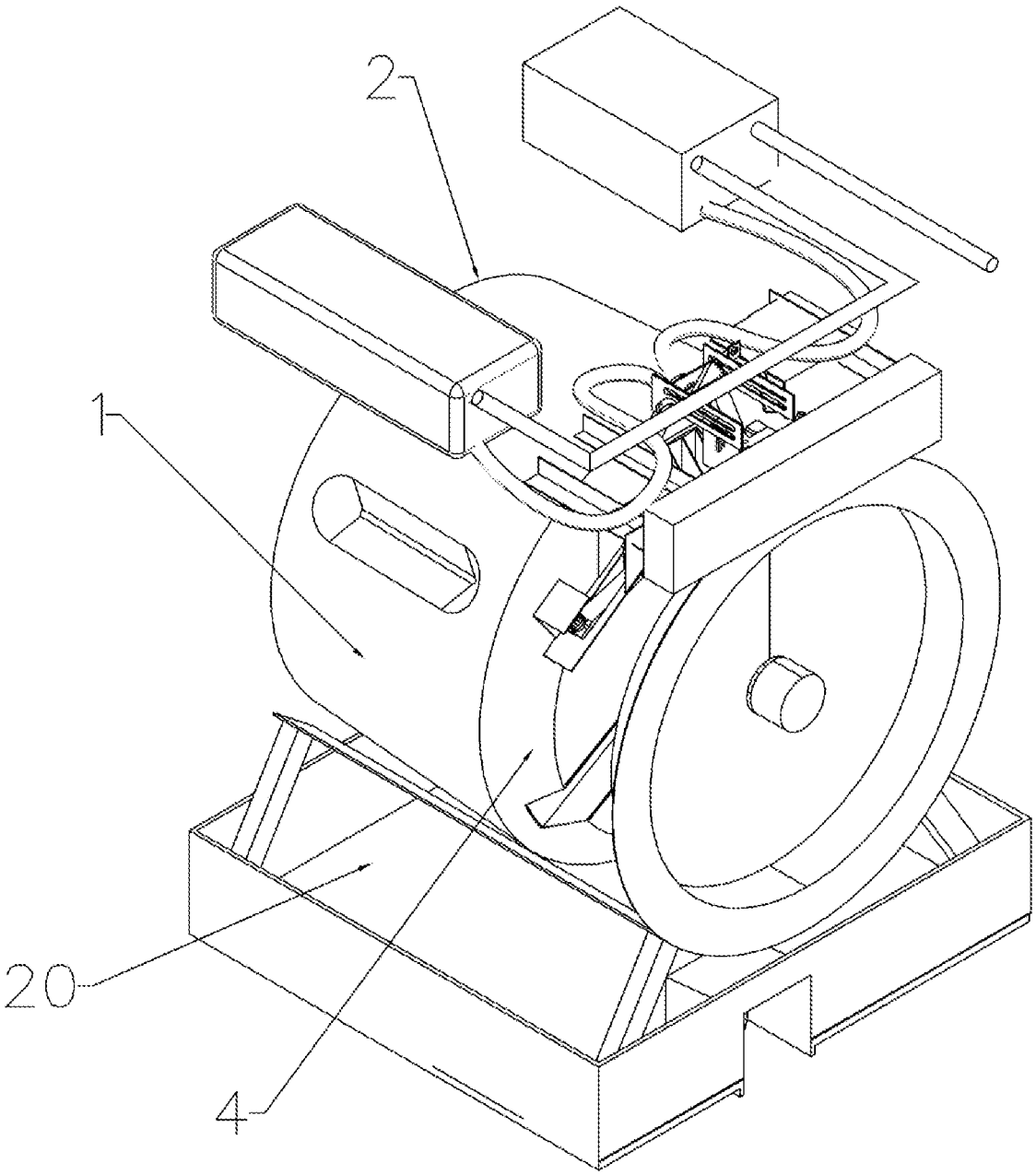
FIG. 6 is a perspective view of embodiment 2 from another angle of the present invention.

The water flowing out of the drain hole 5 must be collected and then discharged out of the washing machine. Therefore, the water basin 20 for receiving the water discharged from the drain holes 5 is provided below the washing drum 1. Generally, the water level in the water basin 20 is lower than the lowest end of the washing drum 1, referring to FIG. 5 and FIG. 6.

What is claimed is:

1. A washing machine without an external drum, comprising:

a washing drum provided inside the washing machine, the washing drum provided with an opening for placing and removing laundry, wherein a front end of the washing drum is smaller in diameter than a rear end, and the washing drum is in the shape of a truncated cone;

drain holes provided on the washing drum;

a valve for opening or closing the drain holes, the valve provided on the washing drum and located at a corresponding position of the drain holes;

wherein a bevel is provided between the rear end and a side wall of the washing drum, the drain holes are distributed on the bevel, and the valve includes at least one sealing ring connected with a locking device for opening or closing the drain holes;

wherein the locking device is mounted on a spindle of the washing drum by a bearing and configured to move in an axial direction along the spindle, and provided with a locking shaft set in a tilted track connected to a movement driver.

2. The washing machine without an external drum of claim 1, wherein a water inlet mechanism is provided having a water valve provided on the washing drum, and a water channel provided in the water valve configured to move in the radial direction of the washing drum to connect the inner wall of the washing drum and a water pipe such that during filling water, the water pipe pushes the water valve to move inward toward the inner wall of the washing drum and connects the water pipe to the inner wall via the water channel, and after filing, the water valve moves outwards to close the water channel.

3. The washing machine without an external drum of claim 1, wherein the locking device provides a slide-to-close device for pushing the at least one sealing ring to close the drain holes, the slide-to-close device moves in parallel to a washing drum shaft of the washing drum, and a plate is provided for pushing the at least one sealing ring to the drain holes.

4. The washing machine without an external drum of claim 1, further comprising: a water basin positioned under the washing drum for receiving water discharged from the drain holes.

5. A washing machine without an external drum, comprising:

a washing drum provided inside the washing machine, the washing drum provided with an opening for placing and removing laundry, wherein a front end of the washing drum is smaller in diameter than a rear end, and the washing drum is in the shape of a truncated cone;

drain holes provided on the washing drum; and a valve for opening or closing the drain holes, the valve provided on the washing drum and located at a corresponding position of the drain holes;

wherein a bevel is provided between the rear end and a side wall of the washing drum, the drain holes are distributed on the bevel, and the valve includes at least one sealing ring connected with a locking device for opening or closing the drain holes; and wherein the at least one sealing ring is pivotally installed on the rear end of the washing drum and is connected to a reset spring, the locking device comprises at least a clasp movably mounted on the rear end of the washing drum, and when locked, the clasp locks the at least one sealing ring in position to close the drain holes.

6. The washing machine without an external drum of claim 5, wherein the drain holes are divided into several groups and set along the bevel.

7. The washing machine without an external drum of claim 5, further comprising:

a collision block contacted with the clasp to unlock the at least one sealing ring from the clasp; wherein the collision block is L-shaped.

8. A washing machine without an external drum, comprising:

a washing drum provided inside the washing machine, the washing drum provided with an opening for placing and removing laundry, wherein a front end of the washing drum is smaller in diameter than a rear end, and the washing drum is in the shape of a truncated cone;

drain holes provided on the washing drum; and a valve for opening or closing the drain holes, the valve provided on the washing drum and located at a corresponding position of the drain holes;

wherein a bevel is provided between the rear end and a side wall of the washing drum, and the drain holes are distributed on the bevel, and the valve includes at least one sealing ring connected with a locking device for opening or closing the drain holes; and wherein a water inlet mechanism including a positioning device for aligning the washing drum with the water inlet mechanism and a filling control device is provided, and during water filling, the positioning device aligns an outlet of the filling control device with at least one of the drain holes of the washing drum.

9. The washing machine without an external drum of claim 8, wherein the positioning device, including a block, is configured to move in parallel to a washing drum shaft of the washing drum, and when locking the washing drum, the block contacts with one of the washing drum, the sealing ring, or the clasp to stop the washing drum from rotating.

10. The washing machine without an external drum of claim 8, wherein the filling control device comprises a water tank configured to move axially parallel to the rotation axis of the washing drum, and the water tank connects to a water supply by a water pipe.

11. The washing machine without an external drum of claim 10, wherein the water tank slides along two rails, one of the rails provided with an inclined section, rolling shafts are provided and roll along the rails, and the water tank inclines to align the outlet of the filling control device with the bevel while the water tank slides to the inclined section of the rail.

12. The washing machine without an external drum of claim 10, wherein the water supply comprises a detergent dispenser, an inlet of the detergent dispenser connects to the water pipe, and an outlet of the detergent dispenser connects to the water tank.

13. The washing machine without an external drum of claim 10, wherein the water pipe of the water supply connects to a heater.

* * * * *